US006123272A

United States Patent [19]

Havican et al.

[11] Patent Number: 6,123,272

[45] Date of Patent: Sep. 26, 2000

[54] NOZZLE ASSEMBLY

[75] Inventors: Todd Brian Havican, Matthews, N.C.; Kim C. Reeves, Lexington, Tenn.

[73] Assignee: Coltec Industrial Products Inc., Charlotte, N.C.

[21] Appl. No.: 09/352,533

[22] Filed: Jul. 13, 1999

Related U.S. Application Data

[60] Provisional application No. 60/104,546, Oct. 16, 1998.

[51] Int. Cl.[7] ..... A62C 31/02

[52] U.S. Cl. ..... 239/390; 239/71; 239/391; 239/392; 239/394

[58] Field of Search ..... 239/390, 391, 239/392, 393, 394, 397, 273, 275, 71

[56] References Cited

U.S. PATENT DOCUMENTS

| | | | |
|---|---|---|---|
| 2,027,567 | 1/1936 | Webb . | |
| 2,711,925 | 6/1955 | King . | |
| 2,790,680 | 4/1957 | Rosholt . | |
| 3,081,950 | 3/1963 | Rinkewich | 239/394 |
| 3,516,611 | 6/1970 | Piggott | 239/391 |
| 3,558,061 | 1/1971 | Hansen . | |
| 3,596,835 | 8/1971 | Smith et al. . | |
| 3,704,831 | 12/1972 | Clark . | |
| 3,814,326 | 6/1974 | Bartlett . | |
| 3,982,698 | 9/1976 | Anderson . | |
| 4,094,468 | 6/1978 | Volle . | |
| 4,141,504 | 2/1979 | Anderson . | |
| 4,221,334 | 9/1980 | Christopher . | |
| 4,347,981 | 9/1982 | Hayes . | |
| 4,461,426 | 7/1984 | Christopher . | |
| 4,534,512 | 8/1985 | Chow et al. . | |
| 4,562,967 | 1/1986 | Grothe et al. . | |
| 4,613,080 | 9/1986 | Benson et al. . | |
| 4,666,085 | 5/1987 | Liaw . | |
| 4,717,074 | 1/1988 | Karliner et al. . | |
| 4,890,792 | 1/1990 | Martin et al. . | |
| 4,903,897 | 2/1990 | Hayes . | |
| 5,054,690 | 10/1991 | Olson . | |
| 5,253,807 | 10/1993 | Newbegin . | |
| 5,501,400 | 3/1996 | Kuo . | |
| 5,540,386 | 7/1996 | Roman . | |
| 5,566,886 | 10/1996 | Wang . | |
| 5,598,978 | 2/1997 | Wang . | |
| 5,683,035 | 11/1997 | Wang | 239/394 |
| 5,746,375 | 5/1998 | Guo | 239/397 X |
| 5,772,121 | 6/1998 | Wang . | |
| 5,823,442 | 10/1998 | Guo | 239/394 |
| 5,884,847 | 3/1999 | Christopher | 239/392 X |
| 5,992,762 | 11/1999 | Wang | 239/394 |

FOREIGN PATENT DOCUMENTS

| | | | |
|---|---|---|---|
| 1371366 | 12/1964 | France . | |
| 24 08 316 | 9/1975 | Germany . | |
| 128693 | 6/1950 | Sweden | 239/394 |

*Primary Examiner*—Andres Kashnikow
*Assistant Examiner*—Robin O. Evans
*Attorney, Agent, or Firm*—Cummings & Lockwood

[57] ABSTRACT

A nozzle assembly including a nozzle turret rotatably mounted on a body. The body has a face, an outlet in the face, and an annular seat in the face, surrounding the outlet. A relatively non-compressible strut extends from the face of the body, while a relatively non-compressible spacer abuts the face. A compressible sealing member is positioned in the seat and, when not compressed, extends out of the seat and further from the face of the body than the spacer. The turret has a bore rotatably received on the strut, and the turret abuts the spacer. Nozzles are arrayed in the turret such that the nozzles sequentially align with the outlet of the body as the turret is rotated on the strut. A fastener secures the turret to the strut such that the turret compresses the sealing member to provide a fluid-tight seal between the outlet and the nozzle aligned with the outlet. According to one embodiment, the nozzle assembly further includes structure for indexing the rotation of the turret with respect to the body. According to another embodiment, the nozzles are removably mounted within the turret.

45 Claims, 8 Drawing Sheets

NOZZLE ASSEMBLY

RELATED APPLICATIONS

This application claims priority from U.S. Provisional Patent Application Ser. No. 60/104,546, filed on Oct. 16, 1998, the disclosure of which is herein incorporated by reference in its entirety.

BACKGROUND

The present disclosure relates, in general, to a spraying device, such as a nozzle, a sprayer, a sprinkler or a shower head. Even more particularly, the present disclosure relates to a nozzle assembly having differently configured, and/or sized nozzles arrayed in a turret that can be rotated to align one of the different nozzles with a source of pressurized fluid.

Nozzles, sprinklers, sprayers and shower heads are used during machining and manufacturing processes, for agriculture production, lawn care and gardening, and for bathing, for example. Nozzles are used to produce a fan spray of droplets from a solid stream of pressurized liquid, and can be configured or "sized" to produce different fan spay patterns, different flow rates and/or different droplet sizes.

Raindrop™ brand nozzles, available from Delavan Spray Technologies, a division of Coltec Industries, Inc., of Monroe, N.C., for example, are provided in a variety of configurations to provide different flow rates, fan spray patterns and/or droplet sizes. Each nozzle includes a tubular nozzle body, and a pre-orifice fitting and a nozzle insert received in opposing ends of the nozzle body. The nozzle insert has an elliptical orifice formed by a V-shaped groove intersecting a hemispheric cavity. The pre-orifice fitting has a pre-orifice in alignment with the elliptical orifice. During operation, the pre-orifice fitting meters liquid and directs the liquid in high velocity solid streams to impact a hemispherical surface of the hemispheric cavity, which directs the streams to collide at the elliptical orifice, which in turn discharges a single fan-spray of droplets.

It is desirable to provide a nozzle assembly having differently configured, and/or sized nozzles whereby one of the different nozzles can be easily and quickly selected for use, such that the single nozzle assembly can provide different flow rates, fan spray patterns and/or droplet sizes. Preferably, the nozzles will be removable, such that the assembly can be provided with even more varieties of nozzles. In addition, it is desirable that the nozzle assembly not leak, and be sturdy and resistant to damage and corrosion.

SUMMARY OF THE INVENTION

Accordingly, the present disclosure provides a nozzle assembly having a nozzle turret rotatably mounted on a body. The body has a face, an outlet in the face, and an annular seat in the face, surrounding the outlet. A relatively non-compressible strut extends from the face of the body, while a relatively non-compressible spacer abuts the face. A compressible sealing member is positioned in the seat and, when not compressed, extends out of the seat and a distance further from the face of the body than the spacer. The turret has a bore rotatably received on the strut, and the turret abuts the spacer. Nozzles are arrayed in the turret such that the nozzles sequentially align with the outlet of the body as the turret is rotated on the strut. A fastener secures the turret to the strut such that the turret compresses the sealing member to provide a fluid-tight seal between the outlet and the nozzle aligned with the outlet.

According to one aspect of the present disclosure, a length of the strut between the spacer and an end of the strut received by the bore of the turret is at least equal a length of the bore of the turret.

According to an additional aspect of the present disclosure, the spacer is annular and radially extends outwardly from the strut, and the spacer and the strut are unitary and made from stainless steel.

According to yet another aspect of the present disclosure, the nozzle assembly further includes structure for indexing the rotation of the turret with respect to the body. According to one aspect, the indexing structure comprises notches in one of the turret and the body, and resilient detents on the other of the turret and the body engaging the notches to index the rotation of the turret on the strut. According to another aspect, the notches are in the body and the resilient detents are on the turret.

According to a further aspect of the present disclosure, the nozzles are removably mounted within the turret.

The present disclosure provides another nozzle assembly having a nozzle turret rotatably mounted to a body. The body has a face and an outlet in the face. A strut extends from the face of the body, a button is biased outwardly from the face. The turret is rotatably mounted on the strut, and includes at least one receptacle for sequential alignment with the outlet of the body and the button when the turret is rotated with respect to the body. The receptacle has inner and outer portions divided by a ledge.

The assembly also includes a nozzle received in the receptacle of the turret. The nozzle has a radially extending base caught on the ledge, retaining the nozzle in the receptacle. The base is shaped to pass through the outer portion of the receptacle when the nozzle is rotated within the receptacle to free the base of the ledge. One of the base and the ledge have a notch, while the other of the base and the ledge have a projection for being received in the notch to prevent the nozzle from being rotated within the receptacle.

According to a further aspect of the present disclosure, the body further includes a ring extending from the face around the outlet, ribs extending from the face to a height substantially equal to a height of the ring, and a recess in the face for alignment with the receptacles of the turret. A spring is positioned in the recess, and the button is positioned on the spring and biased outwardly from the face to a height substantially equal to a height of the ring.

BRIEF DESCRIPTION OF THE DRAWINGS

So that those having ordinary skill in the art to which this disclosure pertains will more readily understand how to construct a nozzle assembly in accordance with this disclosure, preferred embodiments of the nozzle assembly will be described in detail hereinbelow with reference to the drawings wherein.

DETAILED DESCRIPTION

Figure 1:
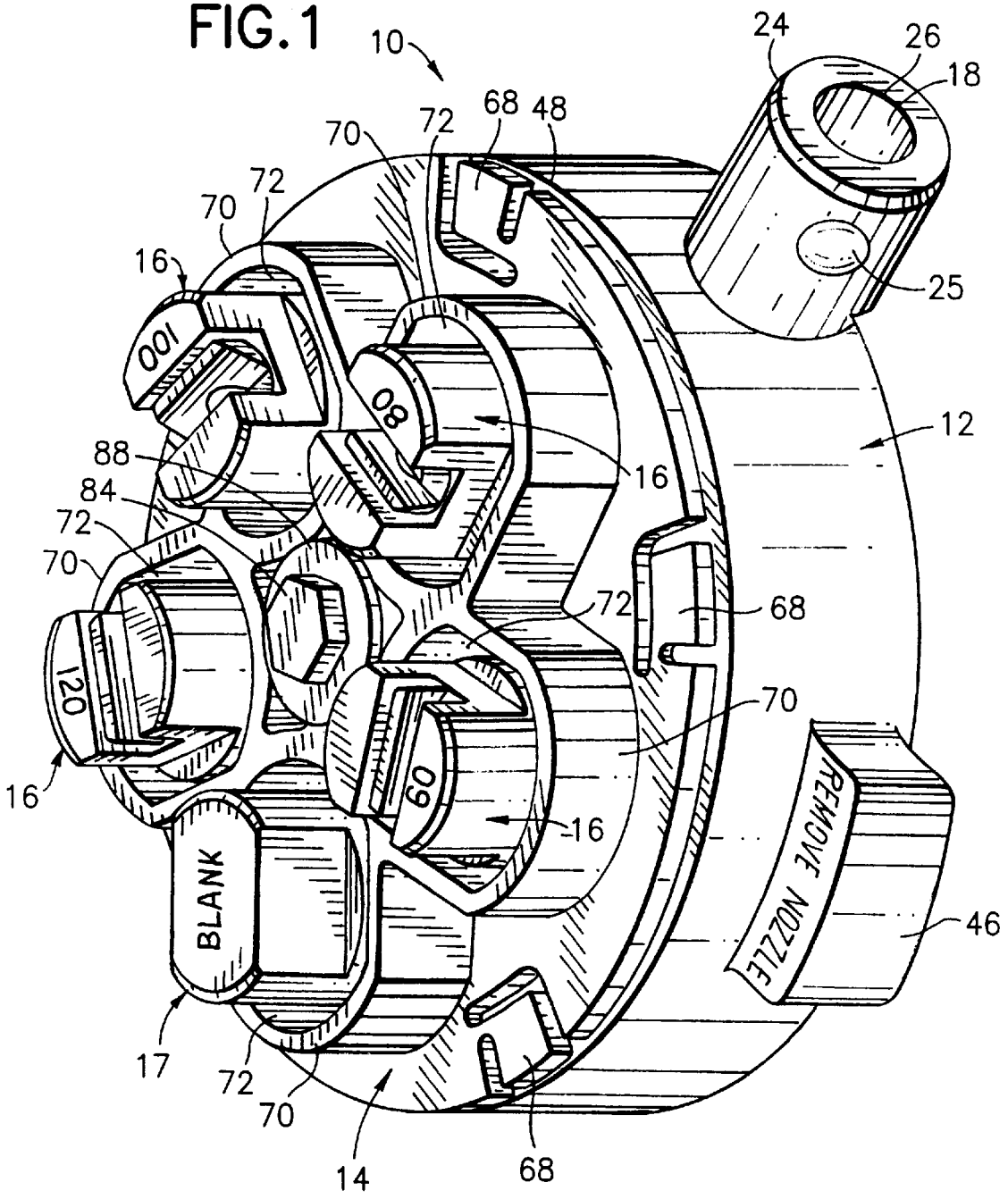
FIG. 1 shows a front isometric view of a nozzle assembly according to the present disclosure.
Figure 2:
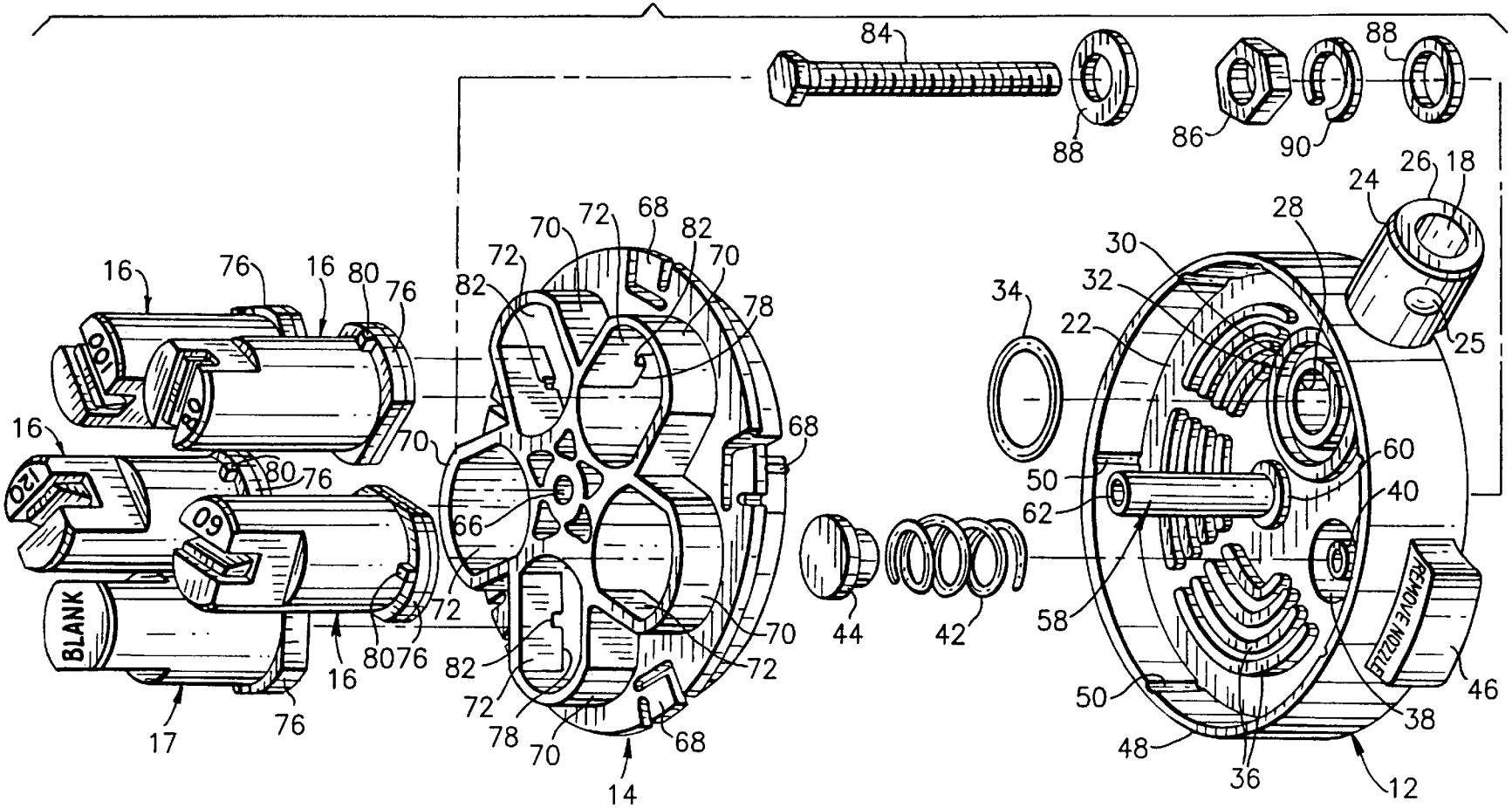
FIG. 2 shows an exploded front isometric view of the nozzle assembly of FIG. 1.
Figure 3:
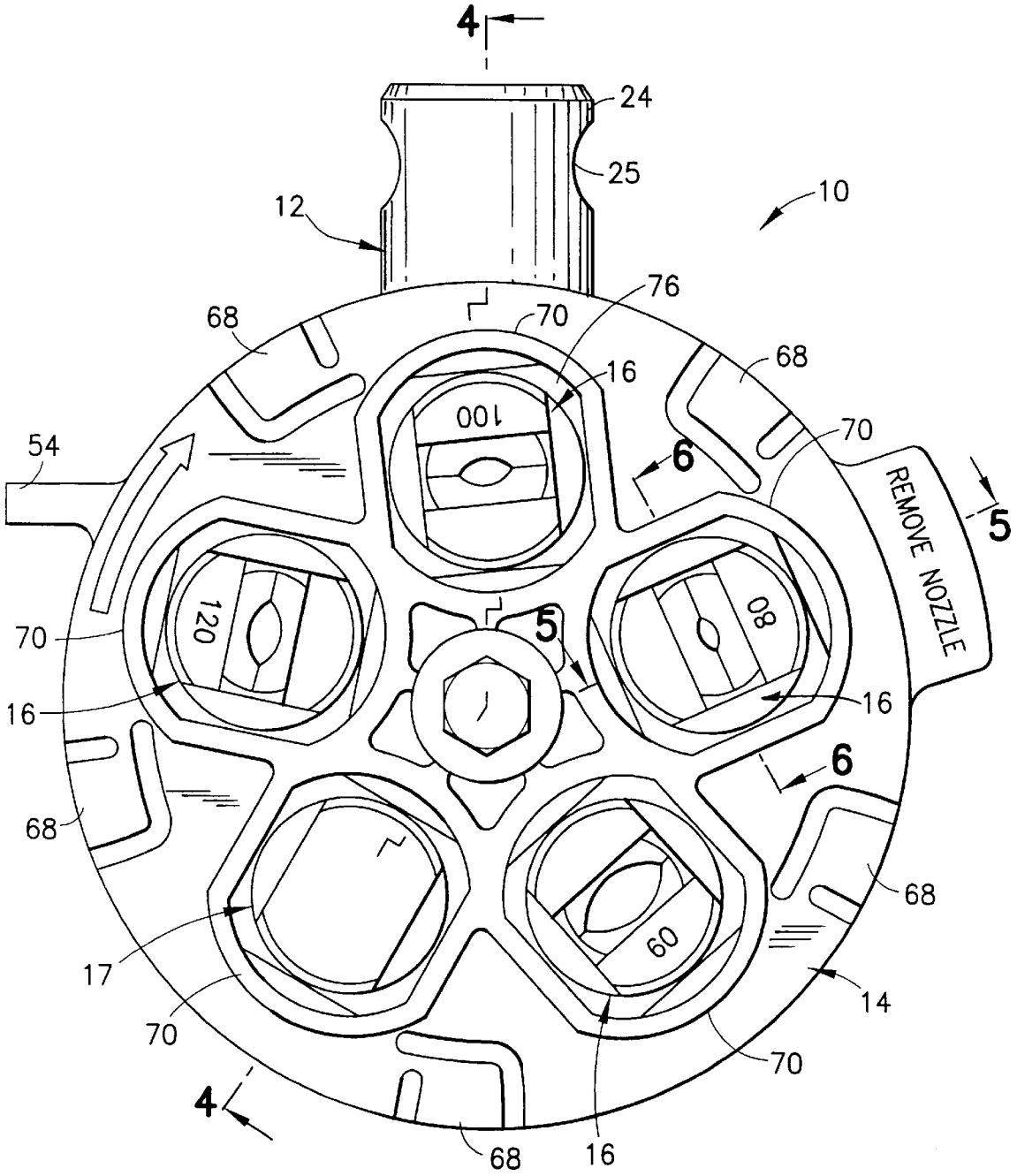
FIG. 3 shows a front elevation view of the nozzle assembly of FIG. 1.
Figure 4:
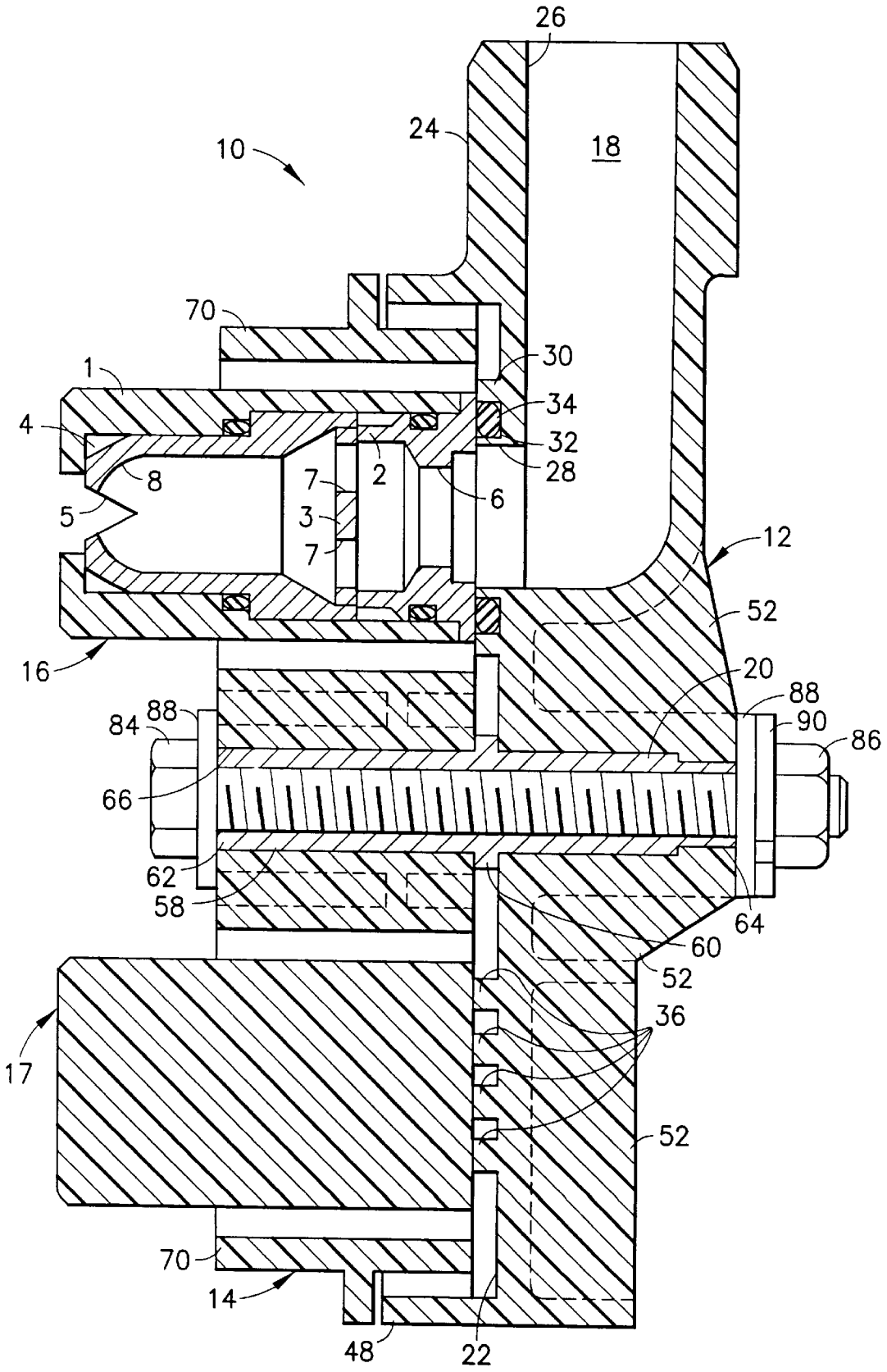
FIG. 4 shows a sectional view of the nozzle assembly of FIG. 1 taken along line 4—4 of FIG. 3.
Figure 5:
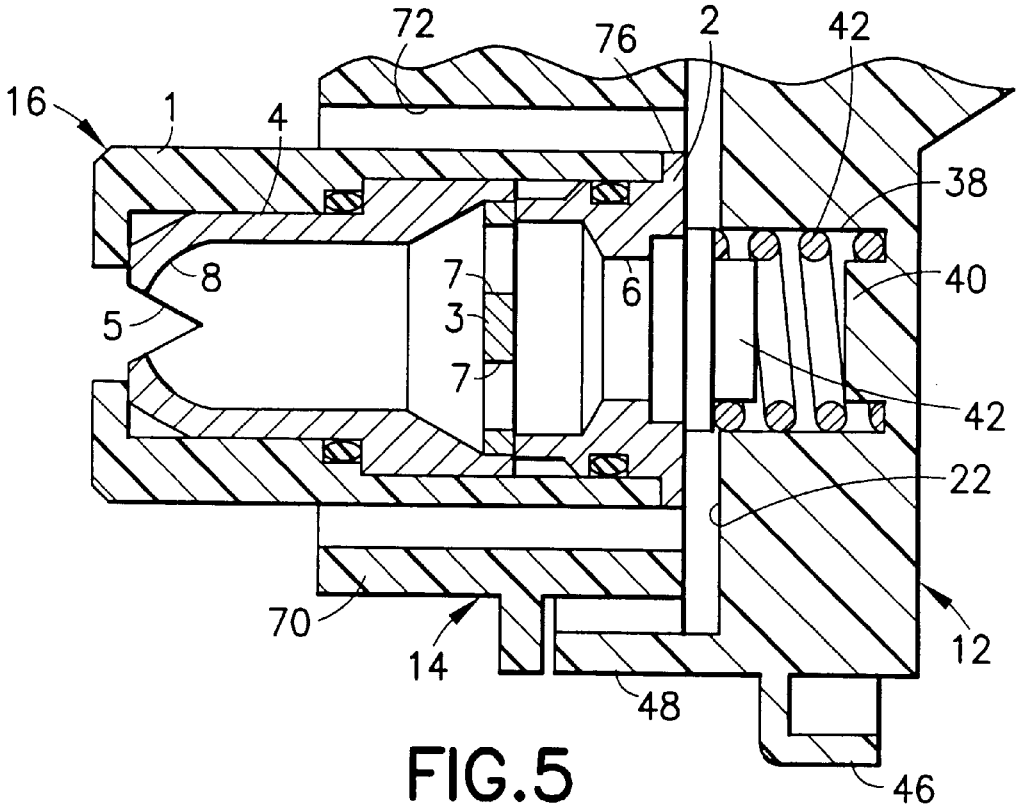
FIG. 5 shows a sectional view of the nozzle assembly of FIG. 1 taken along line 5—5 of FIG. 3.

Referring to FIGS. 1 through 9, a nozzle assembly 10 is disclosed that includes a body 12, a nozzle turret 14 rotatably secured to the body, and different sized nozzles 16 arrayed in the turret. The turret 14 rotates such that one of the nozzles 16 can be aligned with a conduit 18 of the body 12. In this way, flow rate and droplet size of spray from the nozzle assembly 10 can be easily changed with a turn of the turret 14 to sequentially align the different sized nozzles 16 with the conduit 18 of the body 12. In addition to the nozzles 16, the assembly 10 can include a "blank" or solid insert 17 for sealing the conduit 18 of the body 12 when aligned therewith.

The body 12 is generally circular and includes a centrally located bore 20 that extends through the body to a face 22. A tube 24 extends radially outwardly from the body and the conduit 18 extends from an inlet 26 of the tube to an outlet 28 in the face 22 of the body 12. The tube 24 has a narrowed portion 25 such that the tube can be secured by a lock-type connector in a fluid-tight manner to a source of pressurized fluid for spraying, such as a hose, pipe or tank. A ring 30 extends from the face 22, around the outlet 28 of the conduit 18 and has an seat 32. A compressible sealing member 34 having a thickness greater than a depth of the seat 32 is positioned in the seat. The body 12 also includes a plurality of ribs 36 extending from the face 22 to a height equal to a height of the ring 30 surrounding the outlet 28. An annular wall 48 extends from and circles the face 22.

Figure 9:
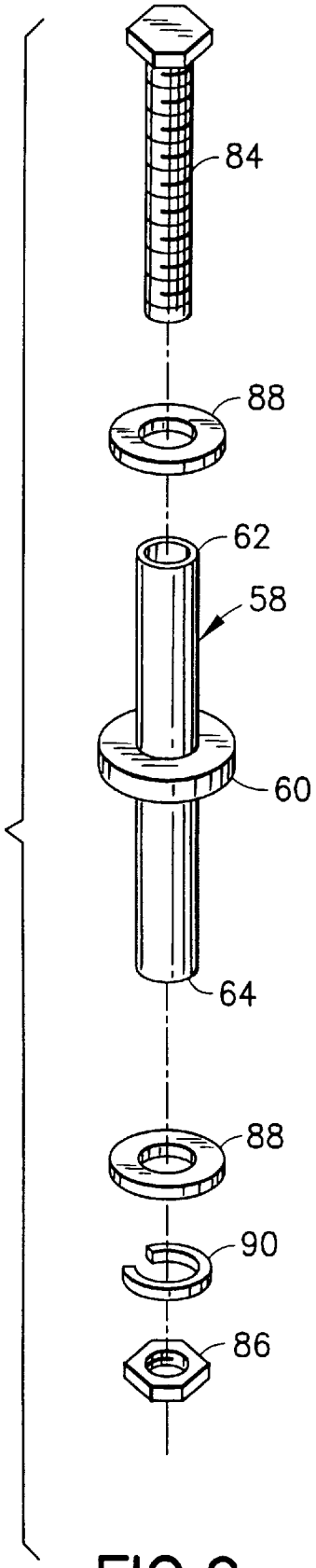
FIG. 9 shows a front isometric view of a strut and fasteners of the nozzle assembly of FIG. 1.

Referring also to FIG. 9, the assembly 10 includes a tubular strut 58 having opposing first and second ends 62, 64, and a relatively non-compressible annular spacer 60 radially extending outwardly from the strut and dividing an outer surface of the strut between the first and the second ends. The second end 64 of the strut 58 is secured within the bore 20 of the body 12, with the annular spacer 60 abutting the face 22 of the body. The strut 58 and the spacer 60 are preferably formed as a single piece from stainless steel.

The annular spacer 60 of the strut 58 has a thickness not greater than the height of the ring 30 surrounding the outlet 28 of the body. Thus, in a non-compressed state, the sealing member 34 extends from the ring 30, surrounding the outlet 28, further from the face 22 of the body 12 than the annular spacer 60. As shown, the sealing member preferably is provided in the form of an oaring 34.

The nozzle turret 14 includes a centrally located bore 66 which is received on the first end 62 of the strut 58 such that the turret fits within the annular wall 48 of the body 12 and abuts the o-ring 34 extending from the ring 30 surrounding the outlet 28. A bolt 84 extends through the tubular strut 58 and is fastened with a nut 86 to secure the nozzle turret 14 to the body 12. Washers 88 and a lock washer 90 are used with the nut 86 and bolt 84, as shown. The nut 86 is tightened at least until the turret 14 compresses the o-ring 34. If there are indications of fluid leakage, the nut 86 can be further tightened until the turret abuts the annular spacer 60, the ribs 36 and the ring 30 extending from the face of the body 12, such that the o-ring 34 is further compressed.

The portion of the strut 58 between the first end 62 and the spacer 60 is at least as long as the bore 66 of the nozzle turret 14, such that the strut acts as a compression limiter so that the nut 86 can be somewhat over-tightened on the bolt 84 without fear of cracking the turret. Preferably, the strut 58 between the first end 62 and the spacer 60 is longer than the bore 66, such that the strut acts as a compression limiter, yet allows the turret 16 to compress the o-ring 34 to provide a fluid tight seal. Since the annular collar 60 of the strut 58 is relatively non-compressible, the collar also provides structural stability and evenly spaces the turret 14 from the body 12 regardless of how tight the nut 86 is turned on the bolt 84. The portion of the strut 58 between the second end 64 and the spacer 60 is at least as long as the bore 20 of the body 12.

Figure 10:
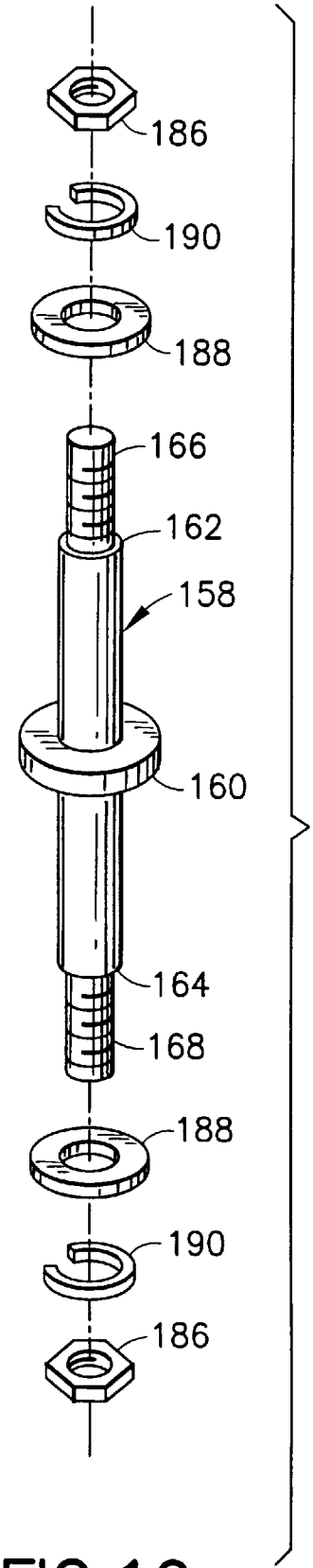
FIG. 10 shows a front isometric view of an alternative strut and fasteners for use with the nozzle assembly of FIG. 1.

Referring to FIG. 10, an alternative strut 158 for use with the assembly is shown. The solid strut 158 has opposing first and second ends 162, 164, and a relatively non-compressible annular spacer 160 radially extending outwardly from the strut and dividing the strut between the first and the second ends. The strut 158 and the spacer 160 are preferably formed as a single piece from stainless steel. The annular spacer 160 of the strut 158 has a thickness not greater than the height of the ring 30 surrounding the outlet 28 of the body, and the portion of the strut between the first end 162 and the spacer 160 is at least as long as the bore 66 of the nozzle turret 14, and preferably longer than the bore 66. The portion of the strut 158 between the second end 164 and the spacer 160 is at least as long as the bore 20 of the body 12. Threaded extensions 166, 168 extend, respectively, from the first and the second ends 162, 164 of the strut 160, and receive washers 188, lock washers 190, and nuts 186 for securing the turret 14 to the body 12. The threaded extensions 166, 168 each have a smaller diameter than the strut 160, such that tightening of the nuts 186 is limited by the first and the second ends 162, 164 of the strut.

Referring back to FIGS. 1 through 8, the assembly 10 also includes means for indexing the rotation of the turret 14 with respect to the body 12 such that the nozzles 16 are precisely aligned with the conduit 18. The means for indexing preferably comprises a plurality of spaced-apart inwardly faced notches 50 in the annular wall 48 of the body 12, which are engaged by resilient detents 68 extending from the outer periphery of the turret 14 to hold the turret in position with respect to the body. A user can manually rotate the turret 14 in an indexed manner with respect to the body 12 by providing enough torque to overcome the resilience of the detents 68. Alternatively, the detents can be provided on the body 12 and the notches provided on the turret 14.

The assembly 10 is designed such that the nozzles 16 and the solid insert 17 can be quickly and easily inserted into and removed from the assembly 10. As shown, the turret 14 includes a plurality of nozzle receptacles 70 arrayed around the centrally located bore 66. Each receptacle 70 has inner and outer portions 74, 72. The outer portions 72 each have an oblong cross-section, which forms ledges 78, while the inner portions 74 each have a circular cross-section. Each ledge 78 includes a notch 82.

The nozzles 16 and the solid insert 17 each have a radially extending, oblong base 76, which match the oblong cross-sections of the outer portions 72 of the nozzle receptacles 70. Thus, the nozzles 16 are inserted, base-first, through the outer portions 72 of the receptacles 70 and rotated in the inner portions 74, such that the radially extending oblong bases 76 of the nozzles 16 catch on the ledges 78 to secure the nozzles in the receptacles. The bases 76 of the nozzles 16 include projections 80 which engage the notches 82 in the ledges 78 of the receptacles 70 such that the nozzles must be pushed inwardly, until the projections 80 clear the notches 82, before being rotated to remove the nozzles from the receptacles. Thus, the nozzles 16 and receptacles 70 are configured for a "twist and lock" engagement between the removable nozzles and the receptacles.

To assist in the removal and insertion of the nozzles 16 into the turret 14, a spring bore 38 is located in the face 22 of the body 12, and includes a boss 40 which receives a spring 42 that in turn biases a button 44 out of the spring bore. The button 44 is biased outwardly generally to a height of the ribs 36, the ring 30 and the annular spacer 60. A handle 46 extends radially outwardly from the body 12, in alignment with the spring bore 38.

During operation, the turret 14 is rotated with respect to the body 12 until a desired nozzle 16 or the solid insert 17 is aligned with the outlet 28 of the conduit 18 of the body, i.e. in alignment with the tube 24 extending from the body. When a nozzle 16 is aligned with the outlet 28, the base 76 of the nozzle 16 compresses the o-ring 34 surrounding the outlet 28 to provide a fluid-tight passage from the conduit through the nozzle. When the solid insert 17 is aligned with the outlet 28, the base 77 of the insert 17 compresses the o-ring 34 surrounding the outlet 28 to provide a fluid-tight seal of the outlet.

Figure 6:
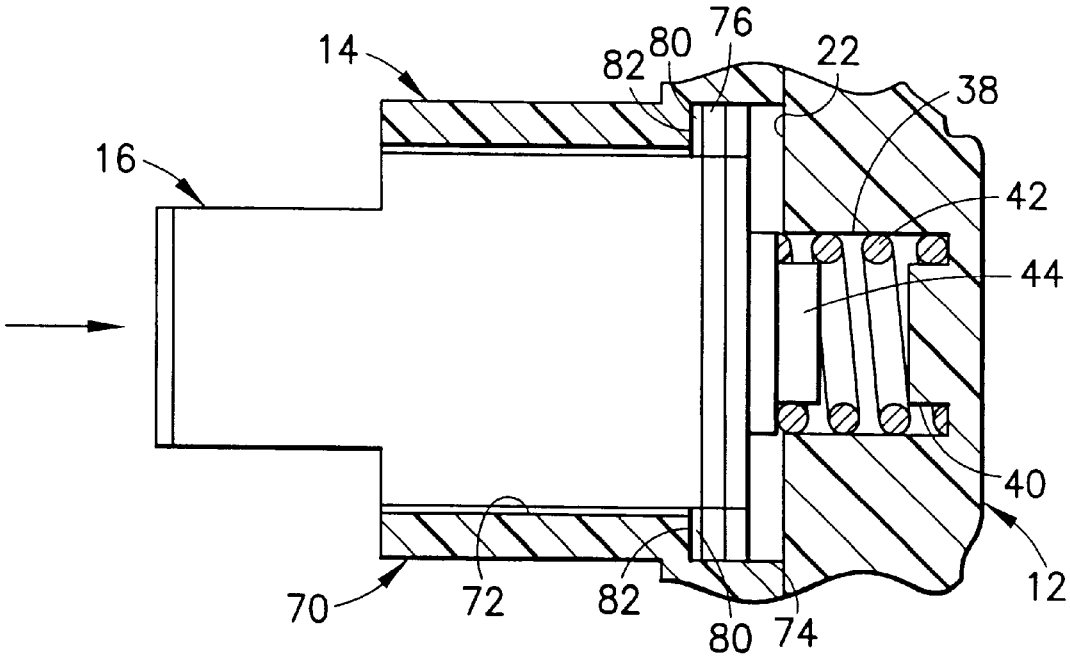
FIG. 6 shows a side plan view of a nozzle and a sectional view of the nozzle assembly of FIG. 1 taken along line 6—6 of FIG. 3.
Figure 7:
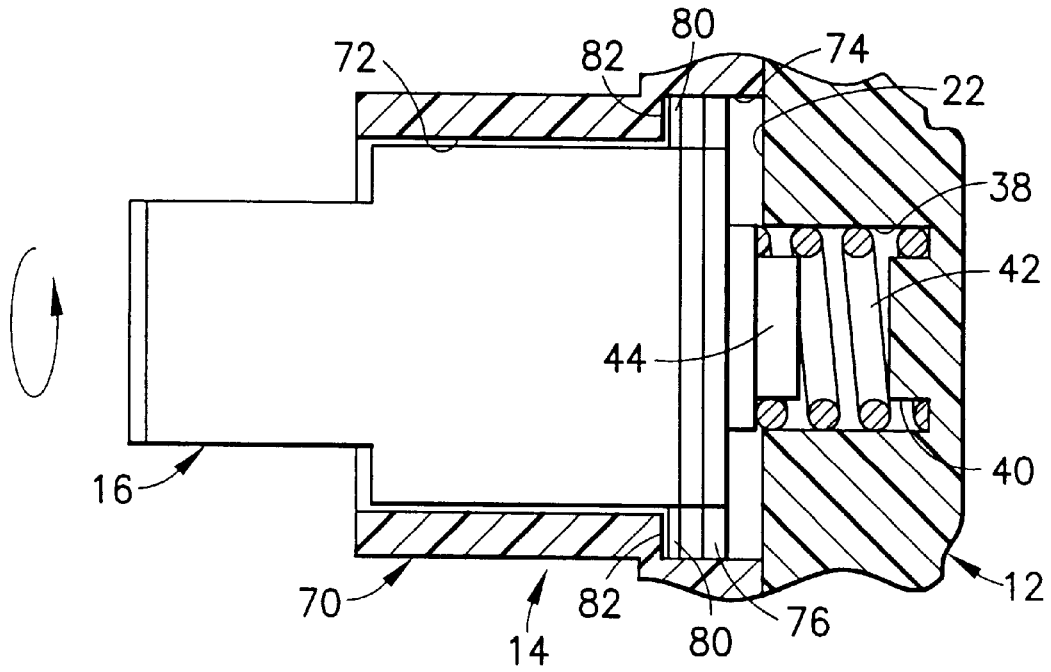
FIG. 7 shows a side plan view of the nozzle and a sectional view of the nozzle assembly of FIG. 1.
Figure 8:
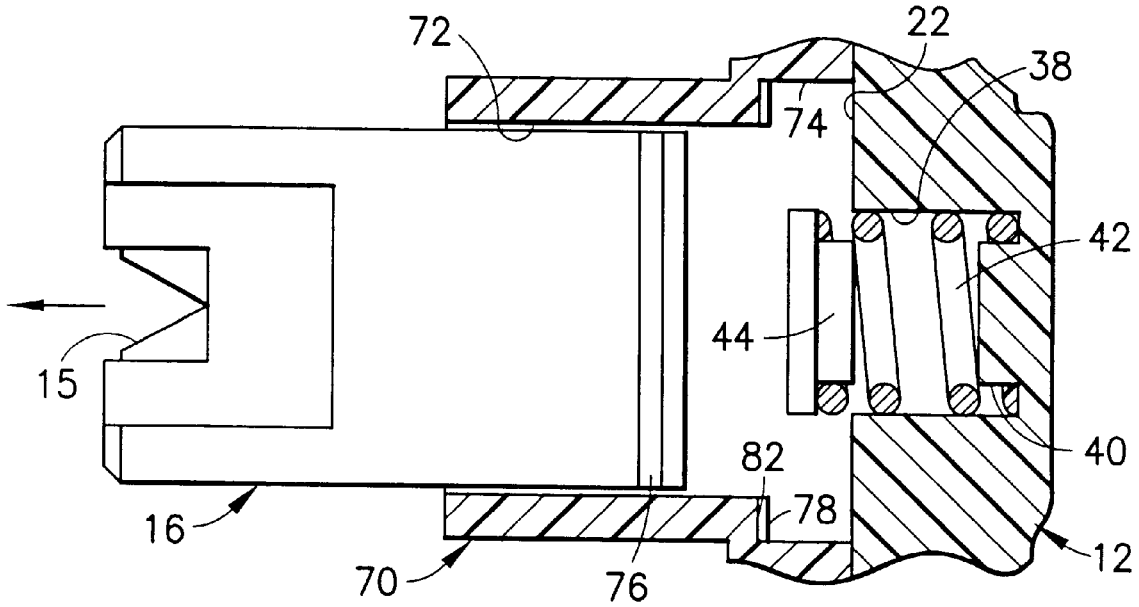
FIG. 8 shows a side plan view of the nozzle and a sectional view of the nozzle assembly of FIG. 1.

When a selected nozzle 16 is to be removed, the turret 14 is rotated until the selected nozzle is aligned with the spring-biased button 44, i.e. aligned with the handle 46 extending from the body 12. The nozzle 16 is then depressed against the button 44, until the projections 80 of the base 76 of the nozzle disengage, or clear, the notches 82 of the ledges 78 of the receptacle 70. While still depressing the nozzle 16, the nozzle is turned until the oblong base 76 of the nozzle clears the ledges 78 and aligns with the oblong outer portion 72 of the receptacle 70 so that the nozzle can be pulled out of the receptacle, as shown in FIGS. 6 through 8.

The nozzles 16 are preferably Raindrop™ brand nozzles available from Delavan Spray Technologies, a division of Coltec Industries, of Monroe, N.C. Raindrop™ nozzles are provided in a variety of configurations to provide different flow rates and droplet sizes. Each nozzle 16 includes a tubular nozzle body 1, a pre-orifice fitting 2, and impingement plate 3 and a nozzle insert 4. The pre-orifice fitting 2 and the nozzle insert 4 are received in opposing ends of the nozzle body 1, with the impingement plate 3 therebetween. The nozzle insert 4 has an elliptical orifice 5 formed by a V-shaped groove intersecting a hemispheric cavity. During operation, the pre-orifice fitting 2 meters and directs pressurized liquid through a pre-orifice 6 in a high velocity solid stream to impact the impingement plate 3. Streams of droplets are then forced through apertures 7 in the impingement plate 3 to impact a hemispherical surface 8 of the hemispheric cavity, which directs the streams to collide at the elliptical orifice 5, which in turn discharges a single fan-spray of smaller droplets. The differently sized and/or differently configured nozzles 16 (and solid insert 17) are all preferably provided in different colors for easier identification of each size and/or configuration.

The turret 14 and the body 12 of the assembly 10 are both preferably formed from a light-weight, rigid, strong, and corrosion-resistant material, such as plastic or reinforced plastic. If used in applications where durability or cleanness,. for example, are more of a factor than cost, the nozzle turret 14, the body 12, the nozzles 16, and the solid insert 17 can all be made of a metal, such as stainless steel, aluminum, brass or copper. The body 12 further includes structural strengthening webs 52. A tab 54 extends outwardly from the body 12 and has a hole 56 therethrough. The tab 54 is used to attach a safety line to the assembly 10 such that the assembly does not become lost, if it is knocked lose from a tractor for example, during a fertilizing or irrigation process.

Figure 11:
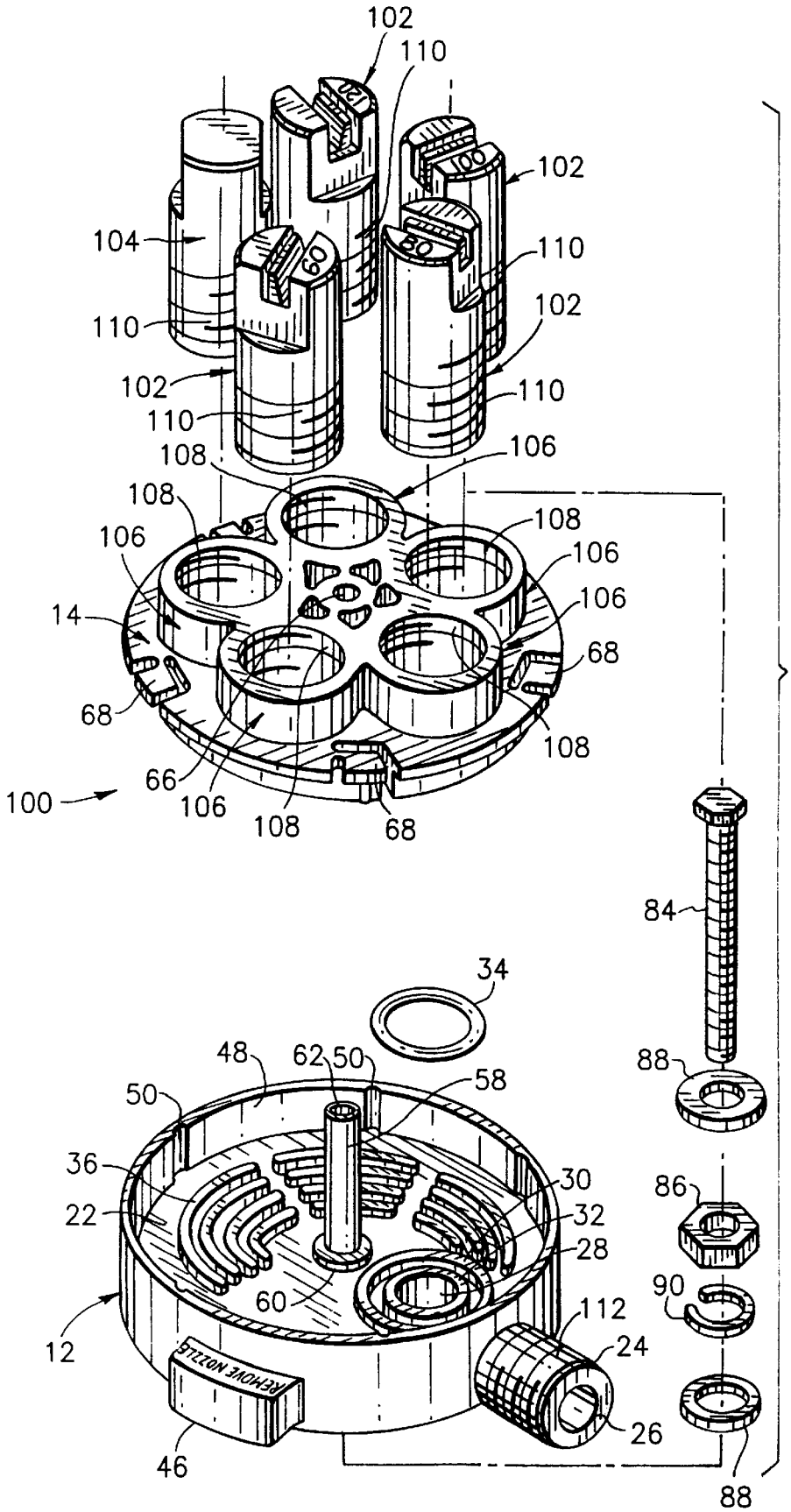
FIG. 11 shows an exploded front isometric view of another nozzle assembly according to the present disclosure.

Referring to FIG. 11, another nozzle assembly 100 is disclosed. The assembly 100 is similar to the assembly 10 of FIGS. 1 through 9, and elements that are the same have the same reference numeral. Instead of being mounted in a twist and lock fashion, however, the assembly 100 includes nozzles 102 and a solid insert 104 that are simply screwed into receptacles 106 of the assembly. The receptacles 106 each have a circular cross-section and threaded inner surfaces 108, which threadingly receive threaded outer surfaces 110 of the nozzles 102 and the solid insert 104. In addition, the conduit tube 24 extending from the body 12 of the assembly 100 has a threaded outer surface 112 for connection to a fluid source. Otherwise, the assembly 100 of FIG. 11 operates in the same manner as the assembly 10 of FIG. 1.

The principles, preferred embodiments and modes of operation of the presently disclosed nozzle assemblies have been described in the foregoing specification. The presently disclosed nozzle assemblies, however, are not to be construed as limited to the particular embodiments shown, as these embodiments are regarded as illustrious rather than restrictive. Moreover, variations and changes may be made by those skilled in the art without departing from the spirit of the presently disclosed nozzle assemblies.

What is claimed is:

1. A nozzle assembly comprising:

a) a body having a face, an outlet extending through the face, and a seat surrounding the outlet;

b) a strut extending from the face of the body;

c) a spacer extending radially from the strut and abutting the face of the body;

d) a sealing member positioned in the seat, the sealing member and the seat dimensioned and configured such that, in an uncompressed state, the sealing member extends from the seat;

e) a turret rotatably mounted by a bore defined therein to the strut, the turret in abutment with the spacer;

f) a plurality of nozzles operatively associated with the turret and positioned for selective alignment with the outlet of the body as the turret is rotated on the strut; and g) a fastener securing the turret to the strut such that the sealing member is compressed between the seat and a selected nozzle aligned with the outlet.

2. The nozzle assembly of claim 1 wherein the sealing member comprises an o-ring.

3. The nozzle assembly of claim 1 wherein a length of the strut between the spacer and an end of the strut received by the bore of the turret is at least equal to a length of the bore of the turret.

4. The nozzle assembly of claim 1 wherein the spacer and the strut are unitary and made from stainless steel.

5. The nozzle assembly of claim 1 wherein:

the strut is tubular; and the fastener comprises a bolt extending through the tubular strut and secured with a nut.

6. The nozzle assembly of claim 1 wherein:

the strut is solid and includes a threaded extension at the end of the strut, the threaded extension having a diameter less than a diameter of the strut; and the fastener comprises a nut threadedly received by the extension.

7. The nozzle assembly of claim 1 wherein the body further includes a ring extending from the face around the outlet and the seat is located on the ring.

8. The nozzle assembly of claim 7 wherein the body further includes ribs extending from the face to a height substantially equal to a height of the ring.

9. The nozzle assembly of claim 1 wherein the turret includes receptacles and the nozzles are removably mounted within the receptacles.

10. The nozzle assembly of claim 1 further comprising:

notches in one of the turret and the body; and resilient detents on the other of the turret and the body engaging the notches to index the rotation of the turret on the strut.

11. The nozzle assembly of claim 10 wherein the notches are in the body, and the resilient detents are on the turret.

12. The nozzle assembly of claim 9 further comprising a spring positioned in a spring bore defined by the body, and a button positioned on the spring and biased against a nozzle aligned therewith for urging the nozzle toward the turret.

13. The nozzle assembly of claim 9 wherein the nozzles are threadingly received within the receptacles.

14. The nozzle assembly of claim 9 wherein:

the receptacles each include inner and outer portions divided by a ledge; and the nozzles each include a radially extending base positioned on the ledge of the receptacle, retaining the nozzle in the receptacle, the base shaped to pass through the outer portion of the receptacle when the nozzle is rotated within the receptacle to release the base of the ledge.

15. The nozzle assembly of claim 14 wherein, for each nozzle and each receptacle:

one of the base and the ledge have a notch and the other of the base and the ledge have a projection for being received in the notch to prevent the nozzle from being rotated within the receptacle, whereby the nozzle must be pushed into the receptacle until the projection clears the notch before the nozzle can be rotated within the receptacle.

16. A nozzle assembly comprising:

a) a body having a face and an outlet in the face;

b) a strut extending from the face of the body;

c) a button biased outwardly from the face of the body;

d) a turret rotatably mounted on the strut, the turret including at least one receptacle for sequential alignment with the outlet of the body and the button when the turret is rotated with respect to the body, the receptacle including inner and outer portions divided by a ledge; and e) at least one nozzle, the nozzle received in the receptacle of the turret and including, a radially extending base caught on the ledge, retaining the nozzle in the receptacle, the base shaped to pass through the outer portion of the receptacle when the nozzle is rotated within the receptacle to free the base of the ledge, one of the base and the ledge having a notch and the other of the base and the ledge having a projection for being received in the notch to prevent the nozzle from being rotated within the receptacle, whereby the nozzle must be pushed into the receptacle against the biased button until the projection clears the notch before the nozzle can be rotated within the receptacle.

17. The nozzle assembly of claim 16 wherein the sealing member comprises an o-ring.

18. The nozzle assembly of claim 16 wherein:

the body further includes, a ring extending from the face around the outlet, ribs extending from the face to a height substantially equal to a height of the ring, a recess in the face for alignment with the receptacles of the turret, a spring positioned in the recess, and the button is positioned on the spring and biased outwardly from the face to a height substantially equal to the height of the ring.

19. The nozzle assembly of claim 16 further comprising means for indexing the rotation of the turret with respect to the body.

20. The nozzle assembly of claim 19 wherein the means for indexing comprises:

notches in one of the turret and the body; and resilient detents on the other of the turret and the body engaging the notches to index the rotation of the turret on the strut.

21. The nozzle assembly of claim 20 wherein the notches are in the body, and the resilient detents are on the turret.

22. A nozzle assembly comprising:

a) a body having, a face, a bore extending through the body, perpendicular with the face, an outlet in the face, the outlet for communication with a source of pressurized fluid, and an annular seat in the face, surrounding the outlet;

b) a relatively non-compressible strut having a second end received in the bore of the body and an opposing first end extending from the face of the body;

c) a relatively non-compressible annular spacer extending radially outwardly from the strut and abutting the face of the body, wherein a length of the strut between the spacer and the second end of the strut is at least equal to a length of the bore of the body;

d) a compressible sealing member seated in the seat, the uncompressed sealing member extending out of the seat and a distance further from the face of the body than the spacer;

e) a turret having a bore rotatably received on the first end of the strut, with the turret abutting the spacer, wherein a length of the strut between the spacer and the first end of the strut is at least equal to a length of the bore of the turret;

f) nozzles removably arrayed in the turret such that the nozzles sequentially align with the outlet of the body as the turret is rotated on the strut;

g) fasteners securing the turret and the body to the strut such that the sealing member is compressed to provide a fluid-tight seal between the outlet and the nozzle aligned with the outlet; and h) means for indexing the rotation of the turret with respect to the body.

23. The nozzle assembly of claim 22 wherein the spacer and the strut are unitary and made from stainless steel.

24. The nozzle assembly of claim 23 wherein:

the strut is tubular; and the fasteners comprise a stud extending through the tubular strut and secured with a nut.

25. The nozzle assembly of claim 23 wherein:

the strut is solid and includes threaded extensions at the first and the second ends, the threaded extension having a diameter less than a diameter of the strut; and the fasteners comprise nuts threadedly received by the extensions.

26. The nozzle assembly of claim 22 wherein the body further includes a ring extending from the face around the outlet to a height substantially equal to a height of the spacer, the annular seat located on the ring.

27. The nozzle assembly of claim 26 wherein the body further includes ribs extending from the face to a height substantially equal to a height of the spacer.

28. The nozzle assembly of claim 22 wherein the means for indexing comprises:

notches in one of the turret and the body; and resilient detents on the other of the turret and the body engaging the notches to index the rotation of the turret on the strut.

29. The nozzle assembly of claim 28 wherein the notches are in the body, and the resilient detents are on the turret.

30. A nozzle assembly comprising:

a) a body having a face, an outlet extending through the face, a ring surrounding the outlet and having a seat formed therein, the ring having a predefined height, and one or more ribs extending from the face to a height substantially equal to the height of the ring;

b) a sealing member positioned in the seat;

c) a turret rotatably mounted to the body and including a plurality of receptacles for selective alignment with the outlet when the turret is rotated with respect to the body; and d) a nozzle removeably received within each receptacle, each nozzle including a base configured for retainment between the turret and one of the ring and the one or more ribs, and wherein the base of the nozzle that is aligned with the outlet is spaced a sufficient distance from the ring such that the sealing member is at least partially compressed between the seat and the base of the nozzle.

31. The nozzle assembly of claim 30 further comprising notches in one of the turret and the body, and resilient detents on the other of the turret and the body engaging the notches to index the rotation of the turret on the strut.

32. The nozzle assembly of claim 31 wherein the notches are in the body and the resilient detents are on the turret.

33. The nozzle assembly of claim 30 further comprising a strut extending from the face of the body and a spacer extending radially from the strut and abutting the face, and wherein the turret has a bore that is rotatably received on the strut and the turret abuts the spacer.

34. The nozzle assembly of claim 33 wherein the spacer and the strut are unitary and made from stainless steel.

35. The nozzle assembly of claim 30 wherein the receptacles each include inner and outer portions divided by a ledge and the base of each nozzle is positioned on the ledge of the receptacle in which it is received and shaped to pass through the outer portion of the receptacle when the nozzle is rotated within the receptacle.

36. The nozzle assembly of claim 30 wherein each nozzle and each receptacle is configured so that one of the base and the ledge has a notch and the other of the base and the ledge has a projection for receiving the notch.

37. The nozzle assembly of claim 30 further comprising a spring positioned in a spring bore defined by the body, and a button positioned on the spring and biased against a nozzle aligned therewith for urging the nozzle toward the turret.

38. A nozzle assembly comprising:

a) a body having a face, an outlet extending through the face, and a seat surrounding the outlet;

b) a sealing member positioned in the seat;

c) a turret rotatably mounted on the body and including a plurality of receptacles positioned for selective alignment with the outlet when the turret is rotated with respect to the body;

d) a nozzle received within each receptacle, each nozzle including a base configured for retainment between the turret and the body, and wherein the base of the nozzle that is aligned with the outlet is spaced a sufficient distance from the body such that the sealing member is at least partially compressed between the seat and the base of the nozzle; and e) a nozzle biasing mechanism including a spring positioned in a spring bore defined by the body, and a button positioned on the spring and biased against a nozzle aligned with the spring bore toward the turret.

39. The nozzle assembly of claim 38 wherein each receptacle includes an inner portion and an outer portion divided by a ledge, and the base of each nozzle is positioned on the ledge of the receptacle in which it is received and shaped to pass through the outer portion of the receptacle when the nozzle is rotated within the receptacle.

40. The nozzle assembly of claim 38 wherein each nozzle and each receptacle is configured such that one of the base and the ledge has a notch and the other of the base and the ledge has a projection for receiving the notch.

41. The nozzle assembly of claim 38 further comprising notches in one of the turret and the body, and resilient detents on the other of the turret and the body engaging the notches to index the rotation of the turret on the strut.

42. The nozzle assembly of claim 41 wherein the notches are in the body, and the resilient detents are on the turret.

43. The nozzle assembly of claim 38 wherein the body has a clearance region around the spring bore to receive the base of the nozzle aligned with the spring bore.

44. The nozzle assembly of claim 38 further comprising a strut extending from the face of the body and a spacer extending radially from the strut and abutting the face, and wherein the turret has a bore that is rotatably received on the strut and the turret abuts the spacer.

45. The nozzle assembly of claim 44 wherein the spacer and the strut are unitary and made from stainless steel.

* * * * *

UNITED STATES PATENT AND TRADEMARK OFFICE
CERTIFICATE OF CORRECTION

PATENT NO : 6,123,272

DATED : September 26, 2000

INVENTOR(S) : Todd Brian Havican and Kim C. Reeves

It is certified that error appears in the above-identified patent and that said Letters Patent is hereby corrected as shown below:

The Assignee should read: COLTEC INDUSTRIES INC

Signed and Sealed this

Fifteenth Day of May, 2001

*Attest:*

Nicholas P. Godici

NICHOLAS P. GODICI

*Attesting Officer*

*Acting Director of the United States Patent and Trademark Office*